US007374246B2

(12) United States Patent
Jones

(10) Patent No.: US 7,374,246 B2
(45) **Date of Patent: *May 20, 2008**

(54) STADIUM CUSHION

(75) Inventor: Troy Jones, Wichita, KS (US)

(73) Assignee: Integrated Stadium Seating, Wichita, KS (US)

( * ) Notice: Subject to any disclaimer, the term of this patent is extended or adjusted under 35 U.S.C. 154(b) by 29 days.

This patent is subject to a terminal disclaimer.

(21) Appl. No.: 11/380,247

(22) Filed: Apr. 26, 2006

(65) Prior Publication Data

US 2006/0250004 A1 Nov. 9, 2006

Related U.S. Application Data

(63) Continuation of application No. 10/890,818, filed on Jul. 14, 2004, now Pat. No. 7,104,605, which is a continuation-in-part of application No. 10/846,136, filed on May 14, 2004, now Pat. No. 6,926,360, which is a continuation of application No. 10/348,785, filed on Jan. 22, 2003, now Pat. No. 6,739,667.

(51) Int. Cl.
*A47C 15/00* (2006.01)

(52) U.S. Cl. ..... 297/352; 297/252; 297/230.11; 297/254; 297/228.12

(58) Field of Classification Search ..... 297/352, 297/252, 230.11, 230.1, 254, 228.12, 228.13, 297/228.1, 219.1
See application file for complete search history.

(56) References Cited

U.S. PATENT DOCUMENTS 2,152,014 A 3/1939 Ashe et al.
2,260,352 A 10/1941 Trapani
2,707,513 A 5/1955 Lake
2,754,891 A 7/1956 Barron
2,756,808 A 7/1956 Eichorst
2,792,875 A 5/1957 Pirrone
2,822,862 A * 2/1958 Zacks ..... 297/229
3,066,980 A 12/1962 Clute
3,278,226 A * 10/1966 Magnusson ..... 297/228.1
3,556,589 A 1/1971 Messier
4,394,783 A * 7/1983 Simmons ..... 297/230.1
4,396,227 A * 8/1983 Neilson ..... 297/228.11
4,824,169 A * 4/1989 Jarrell ..... 297/284.1
5,297,848 A * 3/1994 Grinnell ..... 297/219.1
5,403,066 A * 4/1995 Drum ..... 297/219.1
5,857,226 A 1/1999 Sommer
5,868,463 A 2/1999 MacKenzie et al.
6,352,306 B1 3/2002 Dreiling
6,502,902 B1 1/2003 Romero
6,648,410 B2 * 11/2003 Sparks ..... 297/228.12
6,652,026 B2 * 11/2003 Toyota et al. ..... 297/229
6,739,667 B1 5/2004 Jones
6,926,360 B2 8/2005 Jones
7,104,605 B2 9/2006 Jones

OTHER PUBLICATIONS

College Comfort Stadium Chair Back Program brochure; College Comfort LLC; 8 pages.

* cited by examiner

*Primary Examiner*—Laurie K Cranmer
(74) *Attorney, Agent, or Firm*—Devan Padmanabhan; Jason M. Hunt; Dorsey & Whitney LLP

(57) ABSTRACT

The present invention is a cushion. The cushion has a seat cushion and a back cushion that are attached with an attachment element. The cushion is intended to provide comfort to a patron using a stadium seat.

11 Claims, 12 Drawing Sheets

STADIUM CUSHION

CROSS-REFERENCE TO RELATED APPLICATIONS

This application is a continuation of U.S. patent application Ser. No. 10/890,818, filed on Jul. 14, 2004 now U.S. Pat. No. 7,104,605, which is a continuation-in-part of U.S. patent application Ser. No. 10/846,136, filed on May 14, 2004 now U.S. Pat. No. 6,926,360, which is a continuation of U.S. patent application Ser. No. 10/348,785, filed on Jan. 22, 2003, now U.S. Pat. No. 6,739,667, the contents of which are incorporated in their entirety by reference herein.

FIELD OF THE INVENTION

The present invention relates to chairs and chair or seat cushions. More specifically, the present invention relates to chairs, chair-backs, and chair and seat cushions that are attachable to or usable with stadium seating, such as bleachers.

BACKGROUND OF THE INVENTION

Bleacher-type seating is often provided for spectator events such as sporting events, concerts, and the like. Such seating is often provided in a permanent setting, such as a stadium, a semi-permanent setting, such as retractable bleachers in a gymnasium, or on a temporary basis for specific events. Bleachers provide simple, efficient and convenient seating for a large number of spectators; however, bleachers do not necessarily provide the most comfortable seating nor do they typically identify an individual seating location.

To improve the comfort of such seating, patrons sometimes bring their own seats or cushions. While an improvement in comfort, such a solution requires the patron to remember to bring their own device, which is often an afterthought and/or a very easily overlooked consideration when attending an otherwise exciting event. In addition, having spectators hauling their own chairs or cushion into a stadium seating arrangement can be inconvenient and possibly even dangerous to other spectators. That is, walkways are narrow and space is extremely limited so carrying extra items (especially if large, bulky or cumbersome) presents a challenge.

Thus, there exists a need to balance the conveniences and mass seating offered through stadium or bleacher seating with a degree of personal comfort.

BRIEF SUMMARY OF THE INVENTION

The present invention, according to one embodiment, is a cushion. The cushion has a seat cushion, a back cushion, and at least one flexible connection element attached to the seat and back cushions. The seat cushion has a seat attachment element engageable with a seat. The seat attachment element is attached at each end to the seat cushion. The back cushion has a seat back attachment element engageable with a seat back. The seat back attachment element is attached at each end to the back cushion.

In an alternative embodiment, the present invention is a cushion having a seat cushion, a back cushion, and at least one flexible strap attached to the seat cushion and the back cushion. The seat cushion has a first stretchable strap engageable with a seat, the stretchable strap being attached at each end to the seat cushion. The back cushion has a second stretchable strap engageable with a seat back, the second stretchable strap being attached at each end to the back cushion. The back cushion also has at least one support attachment element engageable with a seat back support component, the at least one support attachment element being attached to the back cushion.

The present invention in a further alternative embodiment is a method of attaching a cushion to a seat. The method includes positioning a seat cushion on a seat so that the seat is positioned between the seat cushion and a seat attachment element. It further includes positioning a back cushion on a seat back so that the seat back is positioned between the back cushion and a seat back attachment element.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive. The use of descriptive terms such as up, down, vertical and horizontal are for illustrative purposes only, are not meant to be limiting, and are used by way of example with respect to the illustrations presented.

DETAILED DESCRIPTION

The cushions of the present invention, according to one embodiment, can be used is to provide designated, comfortable seating to select patrons in a stadium seating arrangement. For example, the stadium may rent the present stadium cushions to any patron who so chooses. In such a scenario, stadium personnel would most likely secure all of the stadium cushions to the bleachers in the appropriate locations before the arrival of the patrons. This provides many advantages. For example, it can provide a source of advertising, by allowing printed matter to be prominently displayed on the stadium cushions awaiting the arrival of patrons. It also allows a particular space or seating location to be physically identified and/or reserved for a particular patron.

Alternatively, the cushions of the present invention are quickly attachable and detachable from the stadium seating such that a patron could bring the cushion to the stadium, attach it to the patron's seat, and remove the cushion from the stadium when the patron leaves at the end of the event.

Figure 1:
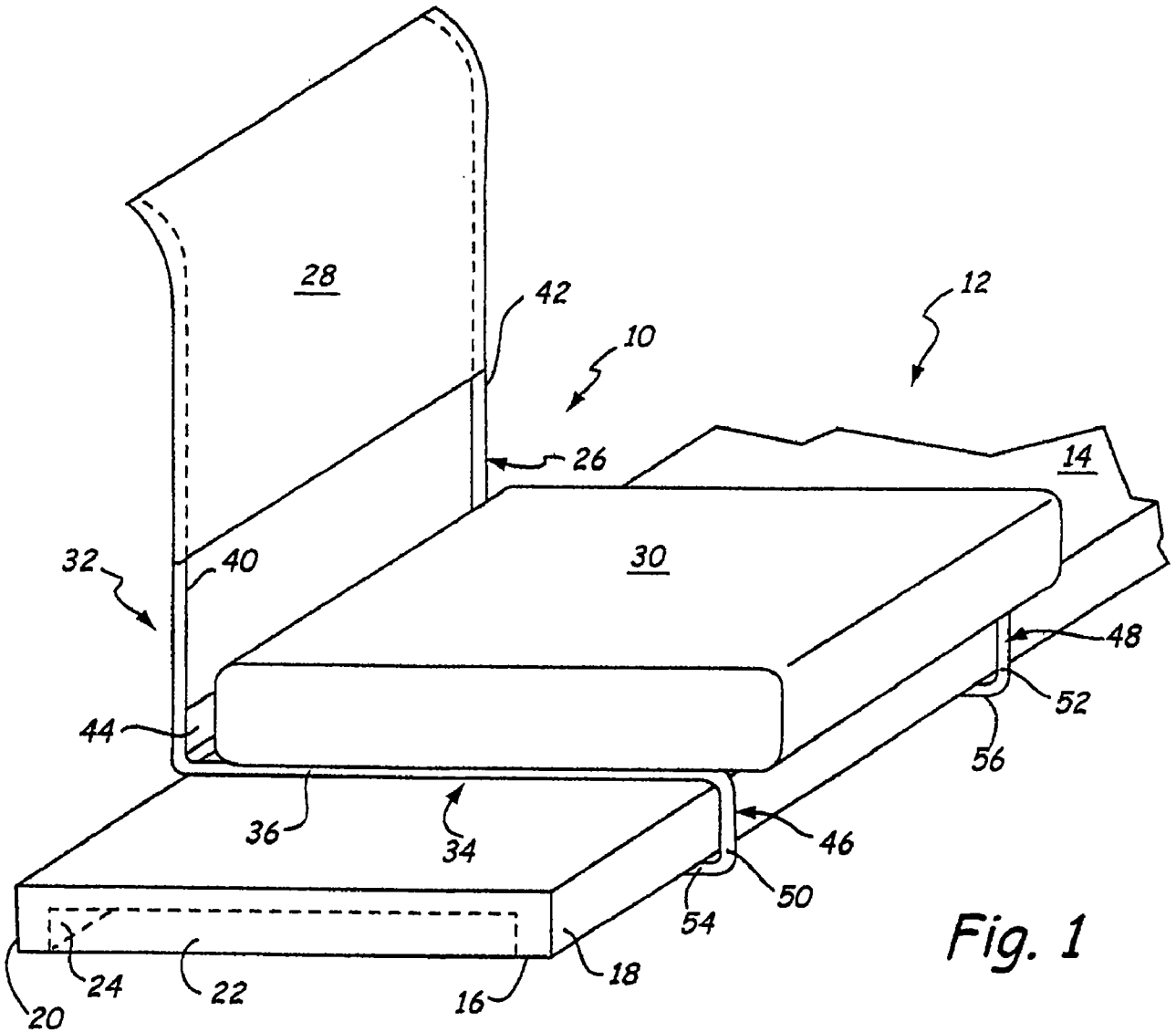
FIG. 1 is an isometric view of a stadium chair attached to a bleacher in accordance with one embodiment of the present invention.

FIG. 1 is an isometric view of a stadium chair 10 attached to a bleacher 12 in accordance with one embodiment of the present invention. The bleacher 12 can take many forms. As illustrated, the bleacher 12 may be an elongated plank-like member having a planar upper seating surface 14, a lower surface 16, a front face 18 and rear face 20. The bleacher 12 may be made from various materials including wood or aluminum. As illustrated in phantom, the bleacher 12 may also include a recess 22 having one or more lips 24 and one or more ribs (not shown) to provide additional structural support.

The stadium chair 10 rests on the upper seating surface 14 and is secured to both the front face 18 and rear face 20 of the bleacher. The particular configuration of the bleacher 12 may affect which particular securement members (described more fully below) should be used.

Figure 2:
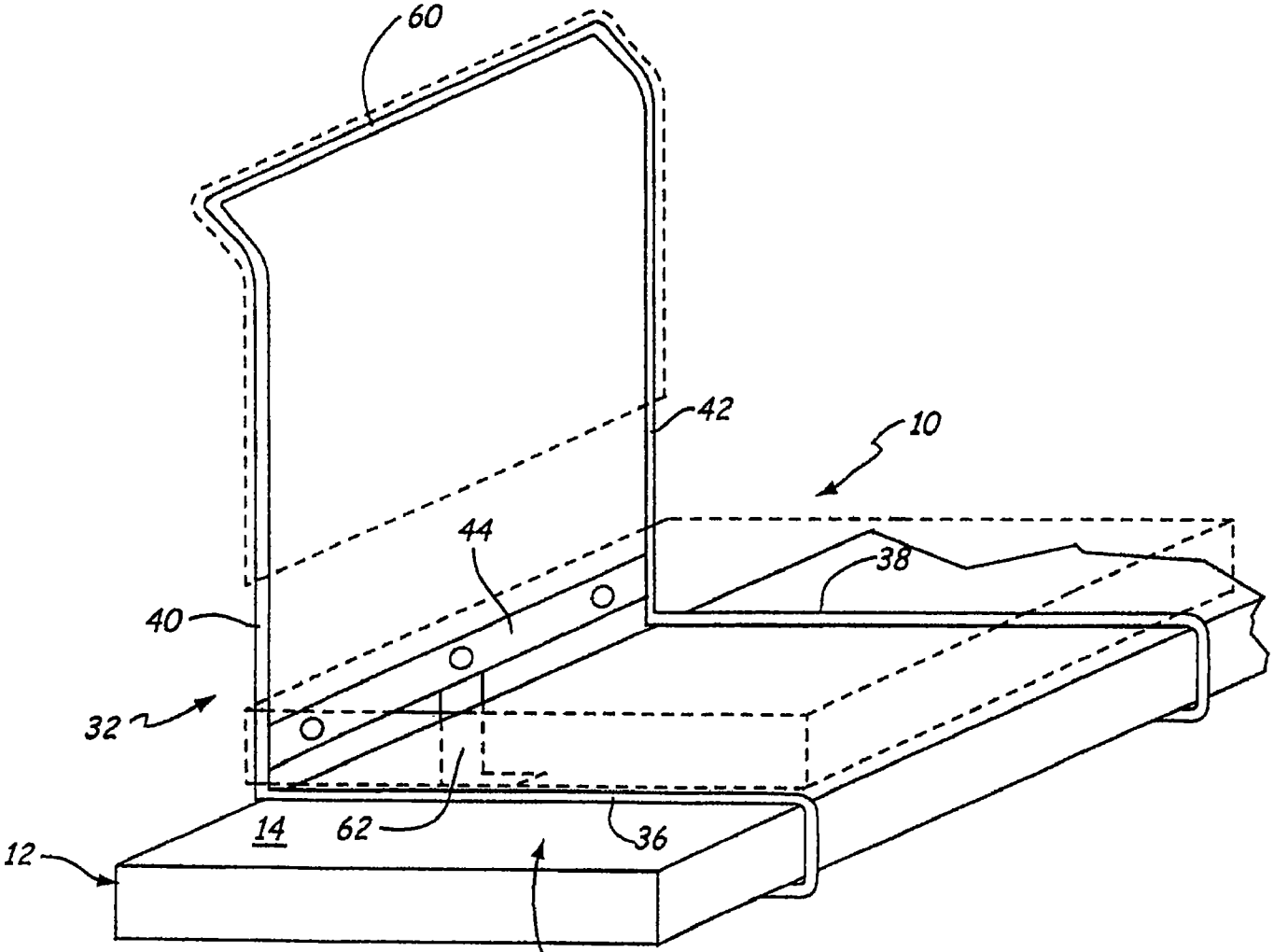
FIG. 2 is a partially sectional view of the stadium chair of FIG. 1.

Referring to FIGS. 1 and 2, the stadium chair 10 includes a frame 26. As illustrated, frame 26 is formed from a tubular or cylindrical member that is appropriately bent at predetermined angles to form the frame structure. The frame 26 could be formed from any suitable material such as metal (e.g., aluminum, steel tubing or steel rod), plastic or the like. The choice of materials will determine whether the frame 26 is formed via bending or as a pre-shaped component (e.g., molded, cast, injection molded). As illustrated, the frame 26 is a single component forming a first generally U-shaped bracket 46 having a first face engaging member 50 and a first lower surface engaging member 54. Likewise, the frame 26 includes at an opposite end a second generally U-shaped bracket 48 having a second face engaging member 52 and a second lower surface engaging member 56.

The frame 26 includes a first horizontal member 36 and a second horizontal member 38 which rest atop the upper seating surface 14 when the stadium chair 10 is positioned as illustrated. The horizontal members 36, 38 define a seat portion 34 of the frame 26. Depending from the horizontal members 36, 38 and extending upwards (as illustrated) is a back portion 32 of the frame 26 that is defined by a first upright member 40 and a second upright member 42. The first and second upright members 40, 42 are optionally interconnected by an upright cross member 60. The upper section of back portion 32 may be angled backwards or away from bleacher 12. This provides a more comfortable seat back for patrons by preventing the upper corners from engaging the back of the patron. In addition, the angled portion aides in securing a backrest 28 to the frame 26. That is, backrest 28 is a flexible member having an interior cavity allowing the backrest 28 to be slipped over the back portion 32. The angle can increase the tension of the backrest 28, making it more secure. In addition, clips (not shown) or other attachment members can be used to temporarily or permanently secure the backrest 28 to the frame 26.

A seat cushion 30 is placed atop the seat portion 34 of frame 26. The seat cushion 30 provides a comfortable seating surface for the patron. The cushion 30 and backrest 28 can be made from any appropriate material such as vinyl, plastic, or the like. If exposed to the environment, the material chosen preferably is suitably durable and/or weather resistant. The cushion 30 and/or the backrest 28 can include a desired amount of padding or cushioning to achieve a desired size, shape and degree of comfort.

In use, the frame 26 is positioned so that the first and second generally U-shaped brackets 46, 48 loop over the front face 18 of the bleacher 12. The shape of the generally U-shaped brackets 46, 48 and the overall rigidity of the frame 26 thus prevent the stadium chair 10 from tipping either forwards or backwards. An attachment bracket 44 is positioned on the back portion 32 of the frame 26, between the first and second uprights 40, 42. The attachment bracket 44 provides additional strength and rigidity to the overall frame assembly. An L-shaped attachment clamp 62 is releasably secured to the attachment bracket 44 and is positioned so that a portion thereof is below the bleacher 12, in contact with lower surface 16, as shown in FIG. 2. Thus, as attachment clamp 62 is tightened against attachment bracket 44, attachment clamp 62 frictionally engages bleacher 12, effectively clamping stadium chair 10 to the bleacher 12. In this manner, stadium chair 10 is prevented from being tilted forwards or backwards; sliding forwards or backwards (e.g., off the bleacher 12), lifted vertically; and if sufficient tension is applied, from sliding horizontally along upper surface 14. Thus, a defined location on the bleacher 12 is presented that provides a comfortable, backed seating position to a patron.

Figure 3:
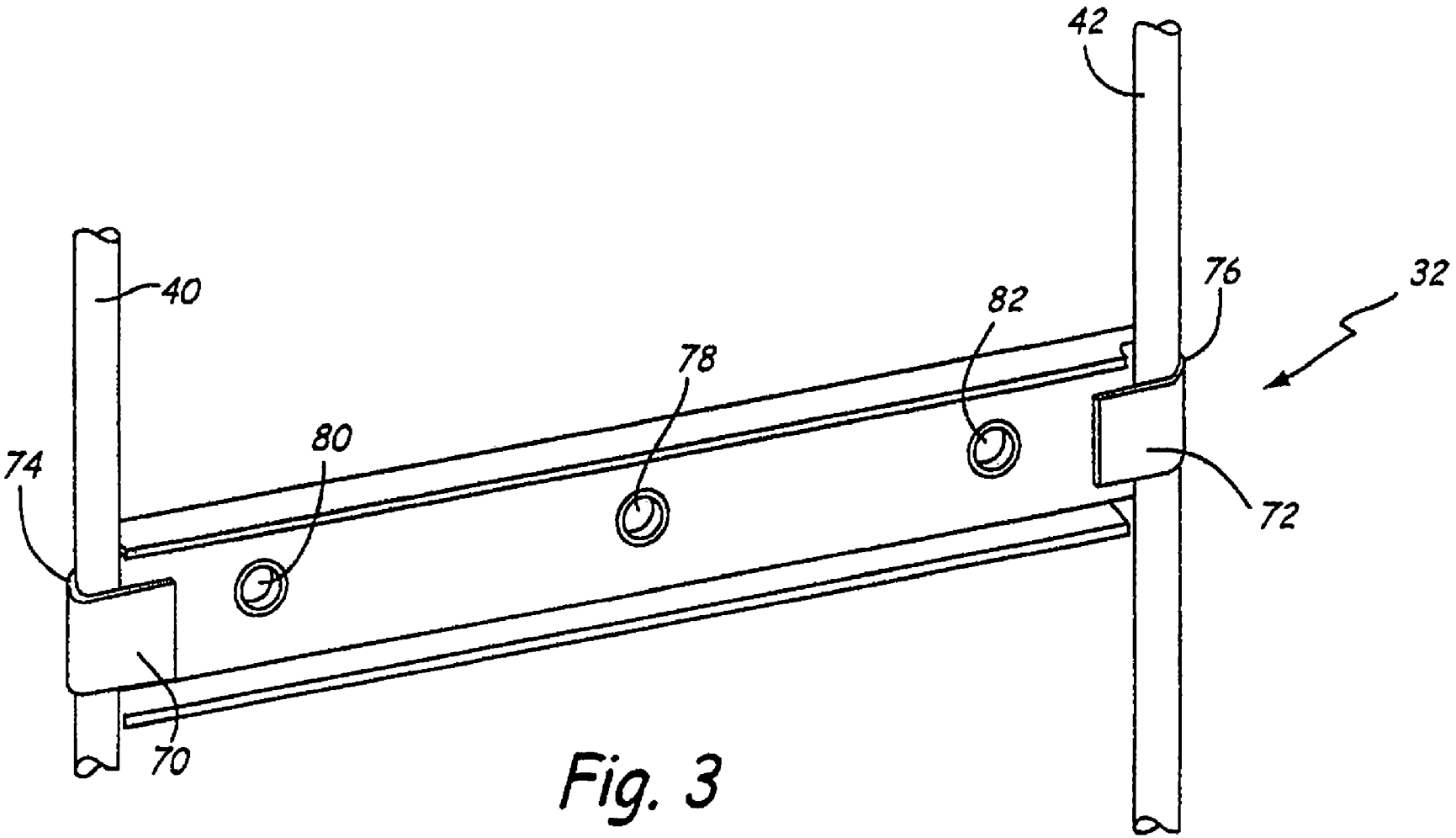
FIG. 3 is an isometric view of a portion of a frame of the stadium chair of FIG. 1 along with an attachment bracket useful in securing the stadium chair to a bleacher.

FIG. 3 is an isometric view of one embodiment of the attachment bracket 44. The attachment bracket 44 is preferably a rigid member made of suitably strong material such as metal. For example, attachment bracket 44 could be stamped, cast, bent or otherwise fabricated from steel, aluminum or the like. Attachment bracket 44 is a channeled member having some degree of depth or thickness. At opposing ends, a first tab 70 and a second tab 72 are provided. The tabs 70, 72 may be bent around upright member 40, 42 respectively to secure the attachment bracket 44 to the frame 26. Other methods of attachment such as bolting, crimping, clamping, welding, or the like may also be used to secure the attachment bracket 44 to the upright members 40, 42 of the frame 26. As the tabs 70, 72 are bent around upright members 40, 42, they form channels 74, 76 that ultimately receive and frictionally engage the upright members 40, 42. Thus, the attachment bracket is securely attached to a given position on the back portion 32 of the frame 26.

The attachment bracket 44 is provided with one or more threaded throughbores 78, 80, 82. If multiple clamps 62 are to be attached they may be balanced by utilizing left and right threaded throughbores 80, 82. If only one clamp 62 is to be used, it may normally be secured to central threaded throughbore 78 or alternatively to any throughbore that is unobstructed. That is, the seat 10 may be positioned as desired and the multiple throughbores 78, 80, 82 provide for multiple attachment points. Thus, if one or more attachment points is obscured or occluded by an obstruction (e.g., a frame member of the bleacher 12), it is a simple matter to utilize one of the other unobstructed attachment points. Fewer threaded throughbores may be provided, more may be provided, and different configurations could also be utilized as desired.

By utilizing an attachment bracket 44, frame 26 can be made as a relatively simple and straightforward component. That is, the frame 26 can be easily and readily produced as can the attachment bracket 44. These two components can be quickly and easily joined to produce a complete frame assembly.

Figure 4:
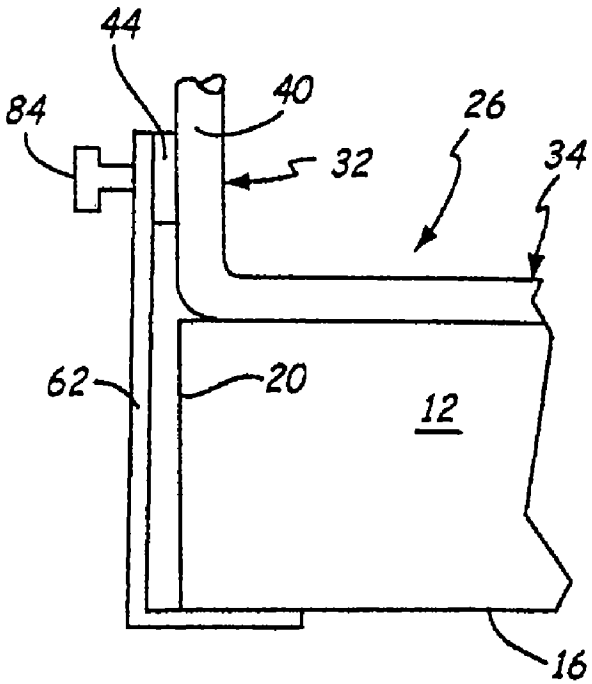
FIG. 4 is a side, planar view illustrating a portion of the stadium chair frame and the attachment to a bleacher with an attachment clamp.

FIG. 4 illustrates how attachment clamp 62 is secured to attachment bracket 44 and how clamp 62 engages bleacher 12. A threaded member such as bolt 84 is passed through an upper portion of clamp 62 so as to engage one of the threaded throughbores 78, 80, 82 illustrated in FIG. 3. Rotating the bolt 84 causes the clamp 62 to abut and engage the attachment bracket 44, in the known way. Thus, by tightening the bolt 84, the clamp 62 is secured; this in turn effectively secures the chair 10 to the bleacher 12. As shown, the clamp 62 is spaced from the rear face 20; however, these two portions could be in contact. Likewise, as illustrated, clamp 62 contacts the lower surface 16; however, a small gap could also be present.

Figure 13:
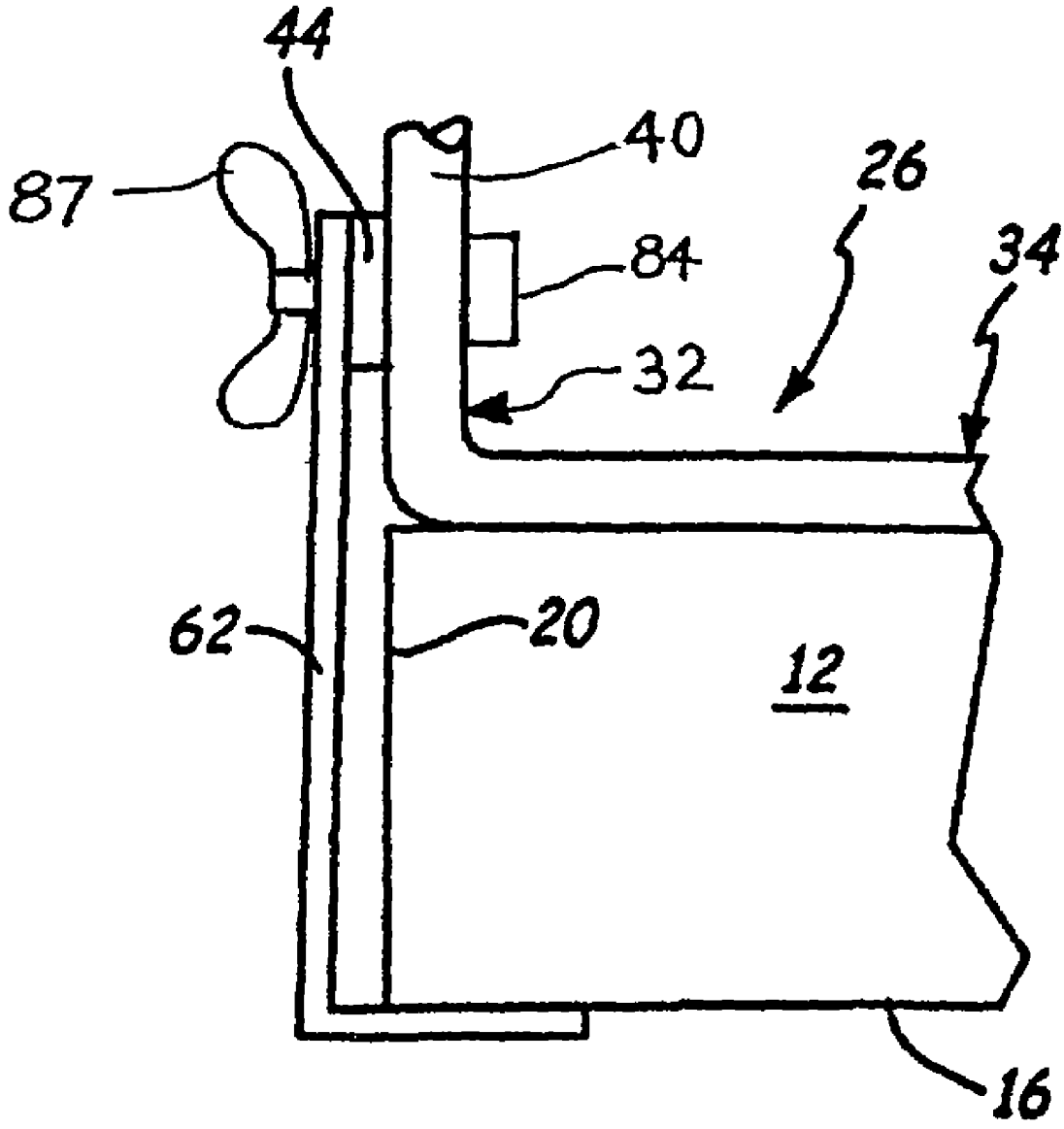
FIG. 13 is a side, planer view illustrating a portion of the stadium chair frame and attachment to a bleacher with an attachment clamp.

In a particularly efficient arrangement, one of the clamps 62 could be loosely attached to each of the chairs 10 prior to installation on the bleachers. Thus, the installer could position the chair 10, pivot the clamp into place, tighten the bolt 84 with a wrench or the like and the chair 10 is installed. When installing hundreds or even thousands of chairs at one time, this efficiency is well placed. Alternatively, various other known attachment mechanisms could be used to secure the clamp 62 to the attachment bracket 44. For example, as shown in FIG. 13, the throughbore 78, 80, 82 need not be threaded. Rather, a threaded member 84 (e.g., a bolt) could be passed therethrough and secured with a fastener 87, such as a nut, wing nut, cotter pin, or the like. This may, in some cases, allow installation and removal without requiring a separate tool. For example, a wing nut could be manually tightened or loosened by hand. In such an example, the bolt head may be positioned underneath the seat cushion 30 so that the wing nut would be exposed from behind the chair 10. Additionally, the clamp 62 could be secured to attachment bracket 44 via any other attachment clamps, levers, connectors or brackets that would allow the clamp 62 to be appropriately tensioned against the attachment bracket 44 with a desired degree of manipulation.

Figure 5:
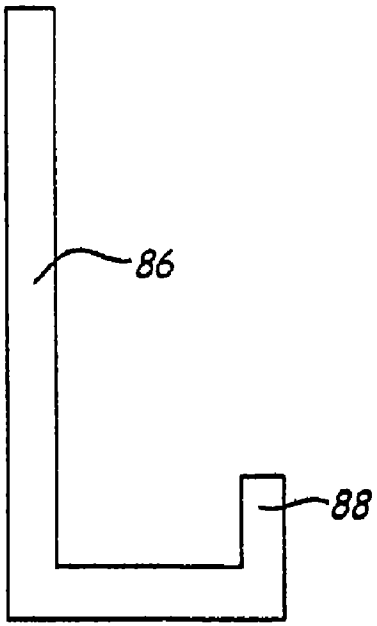
FIG. 5 is side, planar view of an alternative attachment clamp.

As mentioned above, some bleachers 14 may have lips 24 and recesses 22 (FIG. 1). In such a case, a J-clamp 86, as illustrated in FIG. 5, can be utilized. That is, the J-clamp 86 is secured to the attachment bracket 44 instead of the L-shaped attachment clamp 62. The J-clamp 86 includes a lip 88 that is received within recess 22 an may abut lip 24. The J-clamp provides additional security when attaching the seats 10.

With the use of either type of clamp 62, 86 the attachment of the stadium chair 10 to the bleacher 12 is a relatively quick and easy process that results in semi-permanent attachment. That is, the seat cannot be readily removed by a patron (without the aid of a tool such as a wrench). This serves to protect the chairs 10, reduce vandalism, reduce accidental damage, and prevent theft. Also, the chairs (if left over time) need only be positioned once.

Figure 7:
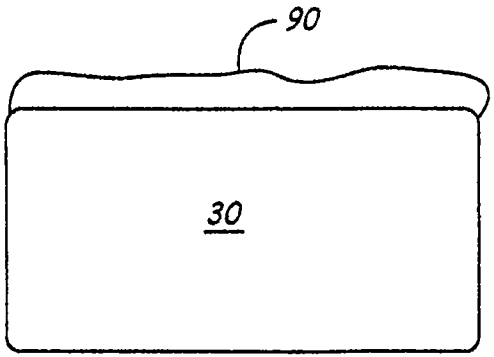
FIG. 7 is a top, planar view of the seat cushion and the securing strap of FIG. 6.
Figure 8:
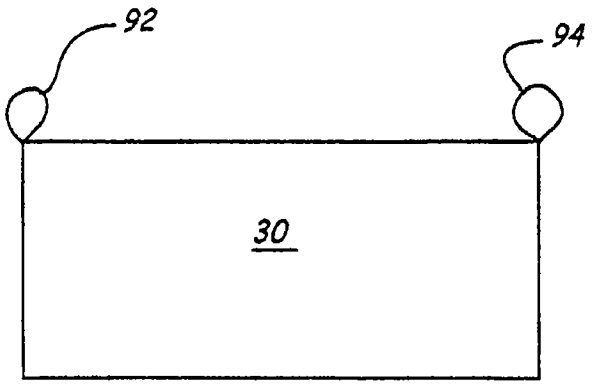
FIG. 8 is a top, planar view of the seat cushion with alternative securement straps for securing the seat cushion to the frame.
Figure 6:
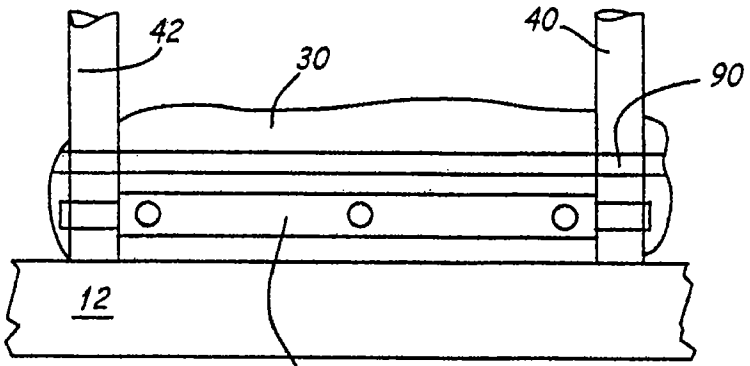
FIG. 6 is a rear, planar view of a securing strap for securing a seat cushion to the frame of the stadium chair.

In furtherance of many of these same goals, it may be desirable to secure the seat cushion 30 to the frame 26. FIGS. 6-7 illustrate having a single securement strap 90 connected to opposite rear corners of the seat cushion 30 that can be looped around the upright members 40, 42. This serves to hold the cushion 30 in the position illustrated and prevent it from being tipped forward. To attach, the cushion 30 is lowered into place while the strap 90 is simply slipped over the upright member 40, 42. Alternatively, the strap 90 could be openable or removable (e.g., hook and loop type fasteners. FIG. 8 illustrates an embodiment where two securing loops 92, 94 are provided. Each loop 92, 94 is placed around one upright member 40, 42 respectively. Again, the individual loops 92, 94 could be slid around the U-brackets 46, 48 of the frame 26, or they could be openable (e.g., buttons, hook and loop type fasteners, etc.). With solid loops 92, 94 it would be difficult and perhaps impossible for the seat cushion 30 to be removed while the frame 26 is secured to the bleacher, depending of course on how tightly the frame 26 engages the bleacher 12. In those cases where the cushion 30 could be removed or when using strap 90, the relevant straps could be further secured to the frame 26 and/or attachment bracket 44 with locking members (e.g., zip ties), if desired.

Figure 9:
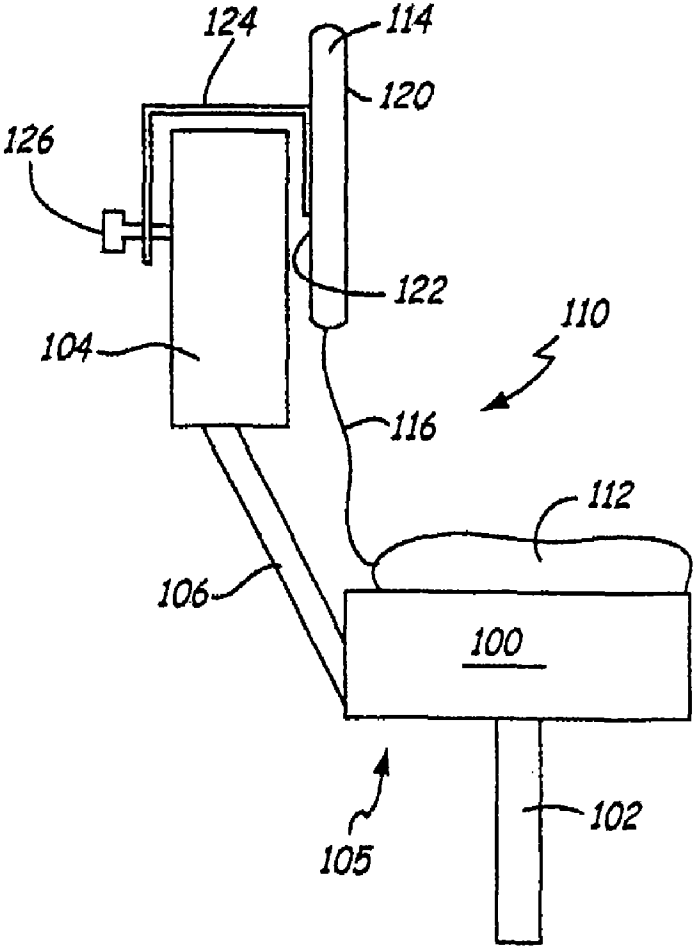
FIG. 9 is a side, planar view of a backed bleacher with a backed stadium seat attached.

FIG. 9 is a side, planar view of a backed bleacher 105 with a backed stadium seat 110 attached. A backed bleacher 105 is any stadium bleacher or bench type seat provided with a structure to support or abut a patron's back. The example illustrated includes a support member 102 and a bleacher seat 100. A bleacher back 104 is coupled to the bleacher seat by a back support column 106. Any number of arrangements are possible for backed bleacher seats and the back and seat portion may be integral, connected or completely separate.

The backed bleacher stadium seat 110 includes a seat cushion 112 which rests on the bleacher seat 100 to provide cushioned comfort to the patron. A back cushion 114 is connected to the seat cushion 112 by one or more flexible members. As illustrated, a first connecting strap 116 and a second connecting strap 118 act as the flexible member in this embodiment.

Figure 10:
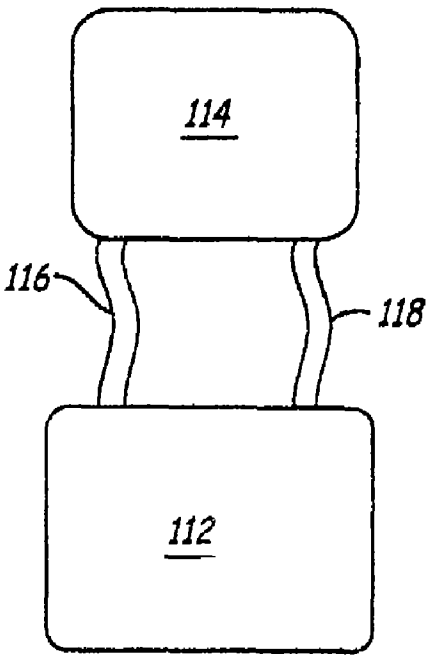
FIG. 10 is front/top planar view of the stadium seat for the backed bleacher.

The back cushion 114 includes a front surface 120 and an opposing rear surface 122 that is proximal the bleacher back 104. A back cushion bracket 124 securely couples the back cushion 114 to the bleacher back support 106. One such bracket 124 is illustrated and is sufficient for attachment; however, more than one bracket 124 (e.g., spacing two such brackets on opposite ends) may also be utilized to attach the back cushion 114. As the seat cushion 112 is coupled to the back cushion 114, the seat cushion is likewise retained proximate to the bleacher 105, though having some degree of permissible movement. FIG. 10 illustrates the interconnection between the back cushion 114 and the seat cushion 112, which are freely movable with respect to one another to the extent that the flexible connecting straps 116, 118 permit such a range of movement.

The backed bleacher stadium seat 110 can be attached to most any backed bleacher 105 to provide cushioned comfort for seating and for back support. As disclosed above, the stadium seat 110 could also be semi-permanently attached to the bleacher seat 105 by virtue of the bracket 124.

Figure 11:
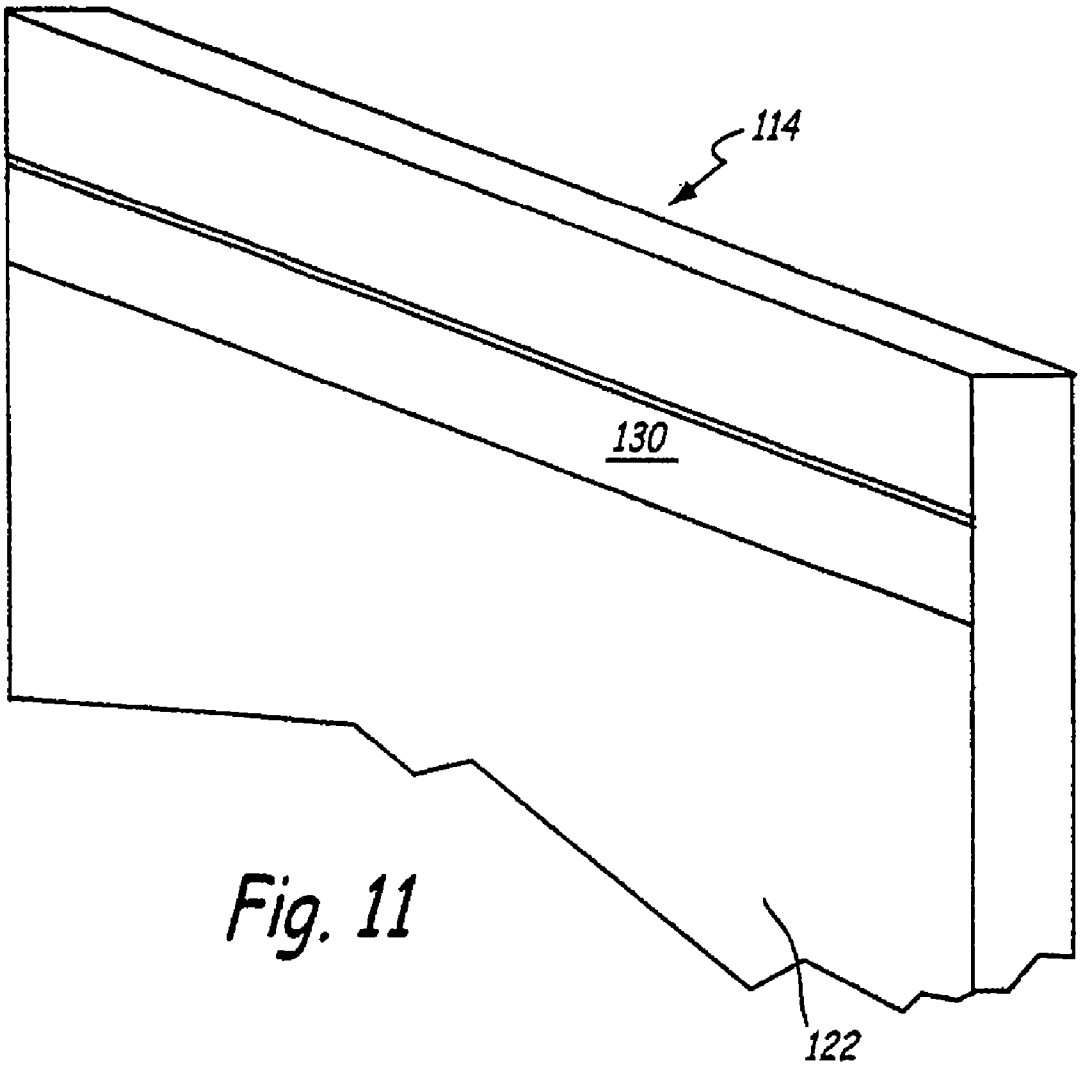
FIG. 11 is a isometric view of a portion of a back cushion of the stadium seat for the backed bleacher.
Figure 12:
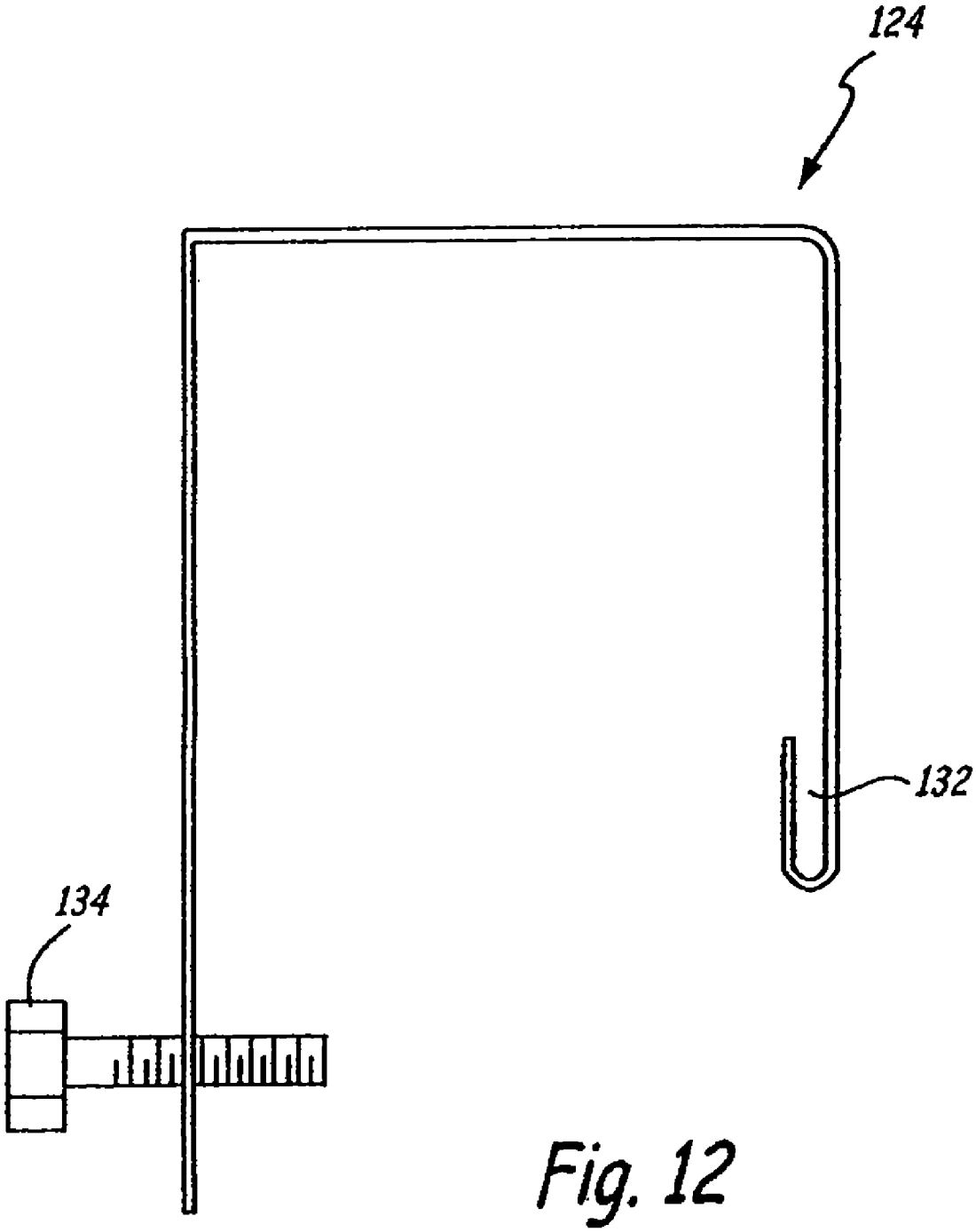
FIG. 12 is a side, planar view of a back cushion bracket for securing the stadium seat for the backed bleacher to the back rest portion of the bleacher.

FIGS. 11 and 12 illustrate one embodiment of the stadium seat 110 allowing for semi-permanent attachment. The rear surface 122 of the back cushion is provided with an attachment strap 130 that spans across at least a portion of the rear surface. As illustrated, strap 130 is provided from one vertical (as illustrated) edge to the opposite edge. This allows maximum adjustability.

A back cushion bracket 124 includes substantially C-shaped bracket having a strap loop 132 at one end and a threaded throughbore 135 at the other end for receiving a locking bolt 134. The bracket 124 is placed over the top portion of the bleacher back 104 (FIG. 9) and the locking bolt is advanced so as to exert pressure against the bleacher back 104 and hold the bracket 124 in place relative to the bleacher back 104. The attachment strap 130 of the cushion 114 is received by the strap loop 132, thus securing the back cushion 114. Depending upon the tension exerted, the back cushion may be horizontally slidable relative to the bleacher back 104; the amount of such movement being determined by the length and flexibility of the attachment strap 30.

In addition to using the stadium seat 110 on a backed bleacher, the seat 110 may also be used on a club seat. Club seats are often provided in stadiums and have a seat portion and a back portion forming a chair. The seat portion often folds upwards towards the back portion to allow more space in an aisle. The use of the stadium seat 110 on a club seat is substantially similar to the use described above. In addition, the seat cushion 112 may be provided with a strap (not separately shown) that is substantially similar to the attachment strap 130 provided on the back cushion 114 (FIG. 11). Such a strap could then be slid under the seat portion of the club seat, serving to retain the seat cushion 112 in place. This is particularly useful on those club seats that fold upwards, as the seat cushion 112 need not be repositioned or reattached each time the patron rises and the club seat folds.

Figure 14:
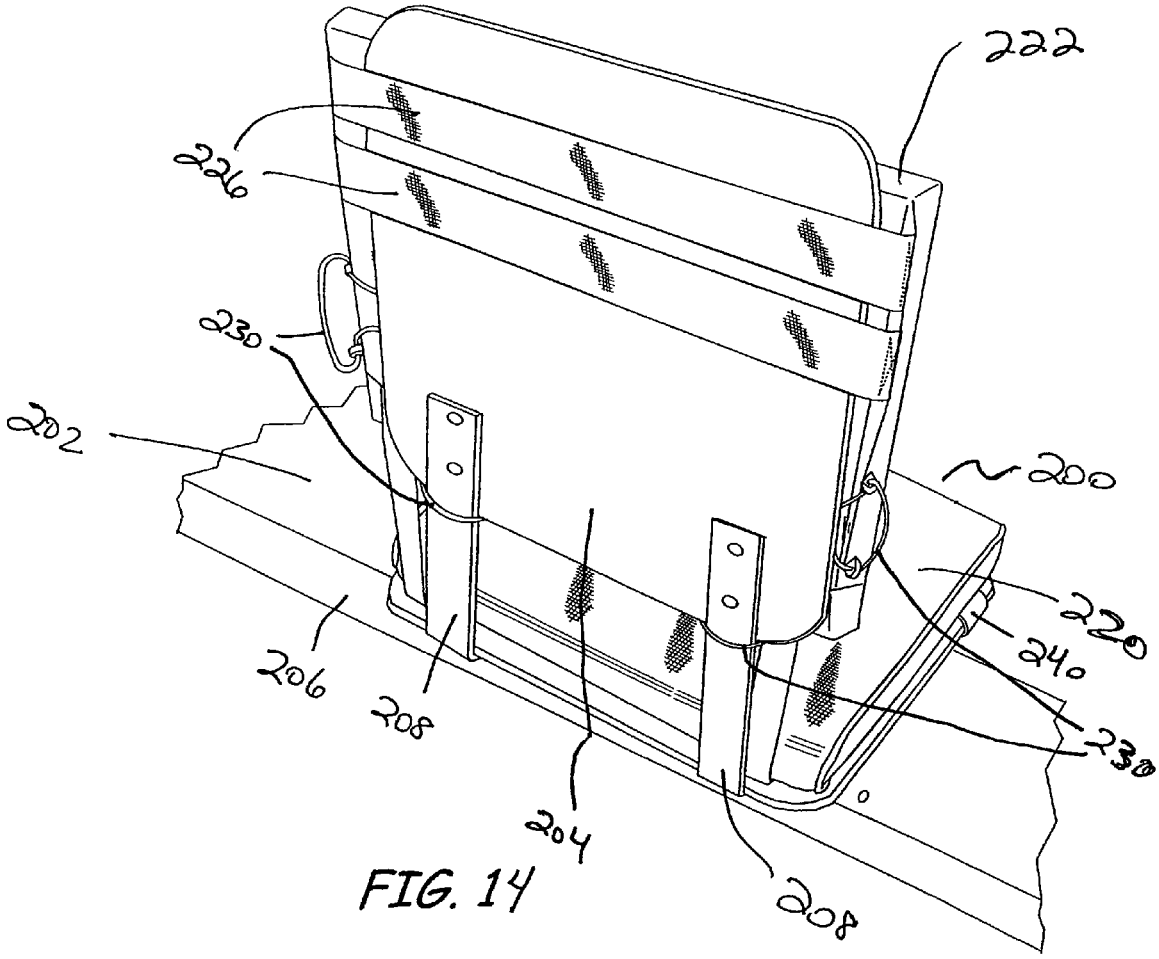
FIG. 14 is a rear perspective view depicting a cushion attached to a portion of a stadium seat, according to one embodiment of the present invention.

FIG. 14 is a perspective view of a stadium cushion 200 attached to a backed bleacher 202, according to an alternative embodiment of the present invention. In this embodiment, the backed bleacher has an separate bleacher back 204 for each seat. The bleacher back 204 is connected to the bench or bleacher 206 by back support elements 208.

Figure 15:
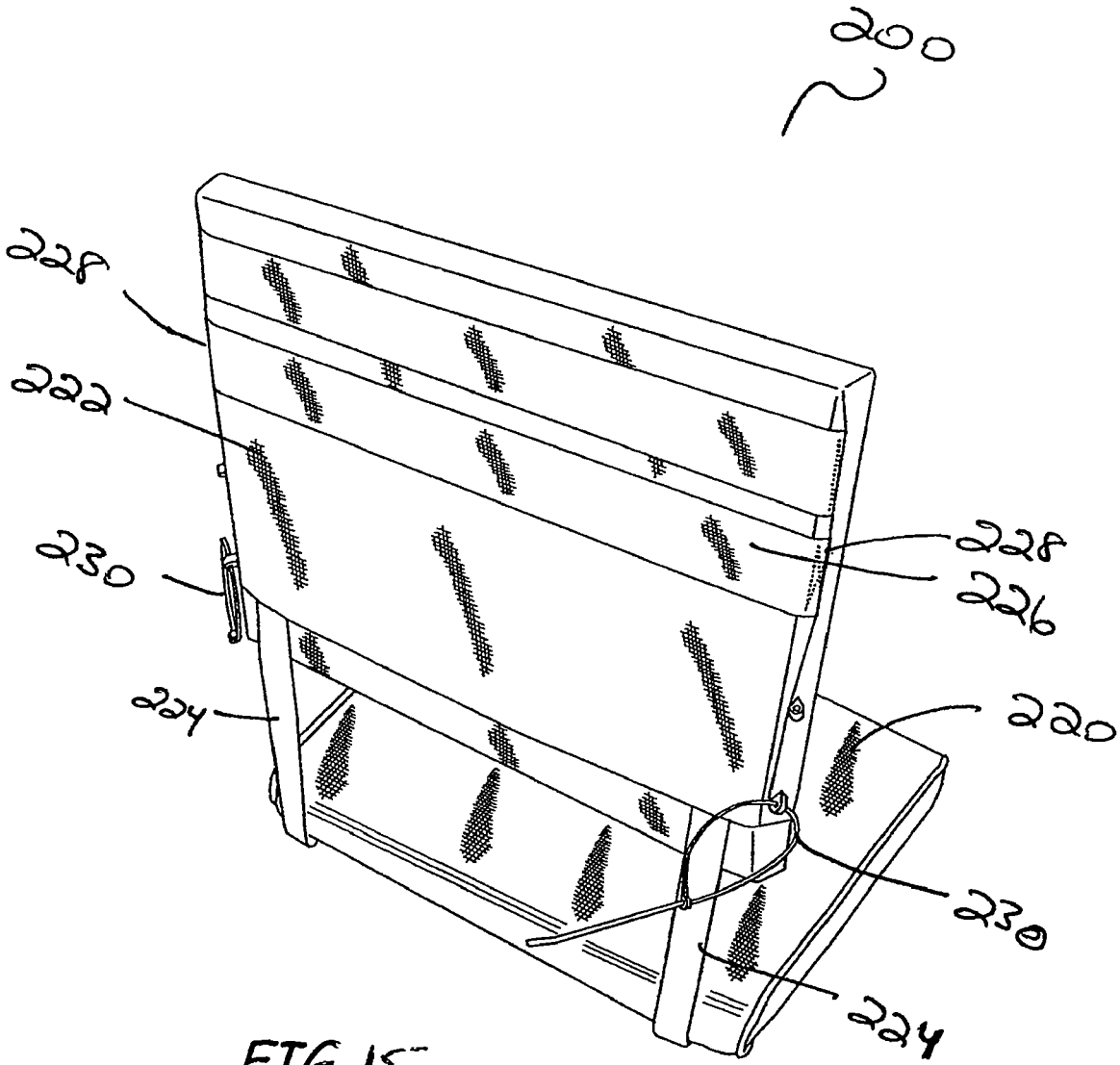
FIG. 15 is a rear perspective view showing a cushion, according to one embodiment of the present invention.

FIG. 15 is a rear perspective view of the stadium cushion 200, according to one embodiment of the present invention. The stadium cushion 200 has a seat cushion 220 and a back cushion 222 that are connected by two connection elements 224. The connection elements 224, in one aspect of the invention, are two flexible straps that allow for the respective positions of the two cushions 220, 222 to be varied for ease of use and transport. Alternatively, the connection elements 224 can be any known device allowing for flexible connection of the seat cushion 220 and the back cushion 222. In a further alternative, the connection element 224 can be a one element allowing for flexible connection of the two cushions 220, 222.

The back cushion 222 has a seat back attachment element 226. According to one embodiment, the seat back attachment element 226 is a stretchable strap that stretches along the back side of the back cushion 222 and is connected at each end 228 to the cushion 222. Alternatively, the seat back attachment element can be any known device for attaching the seat cushion 222 to the seat back 204.

The back cushion 222 also has support attachment elements 230. According to one embodiment, the support attachment elements 230 are adjustable plastic loops that are connected to the back cushion 222 on opposing sides of the back cushion 222. In one embodiment, the support attachment elements 230 are similar to zip ties. Alternatively, the support attachment elements 230 are any known devices for attaching the back cushion to the back support elements 208.

Figure 16:
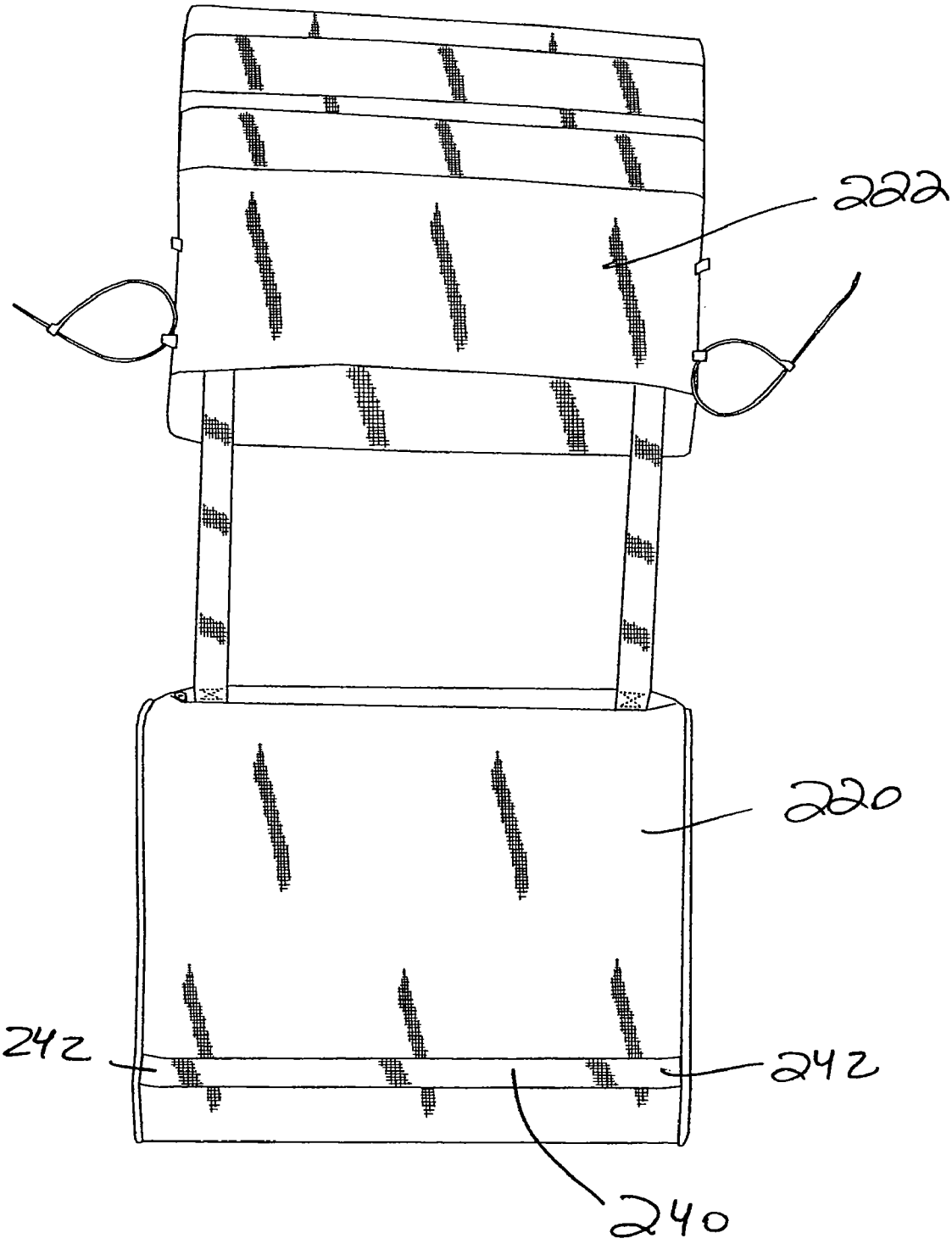
FIG. 16 is a back planar view illustrating a cushion, according to one embodiment of the present invention.

FIG. 16 depicts the back of the back cushion 222 and the underside of the seat cushion 220, according to one embodiment of the present invention. The underside of the seat cushion 220 includes a seat attachment element 240. According to one embodiment, the seat attachment element 240 is a stretchable strap that stretches along the underside of the seat cushion 220 and is connected at each end 242 to the cushion 220. Alternatively, the seat attachment element 240 can be any known device for attaching the seat cushion 220 to the bleacher seat 206.

In use, the stadium cushion 200 is configured to be used with several types of stadium seating. That is, the stadium cushion 200 can be attached to a bleacher seat with separate seat backs as shown in FIG. 14. The seat back attachment element 226 is stretched over the seat back 204 by positioning the back cushion 222 such that the seat back 204 is slid between the seat back attachment element 226 and the back cushion 222. The seat back attachment element 226 thereby stabilizes and maintains the position of the back cushion 222 in relation to the seat back 204.

In addition, the stadium cushion 200 according to one embodiment can be further attached to a stadium seat via the support attachment elements 230. Each element 230 can be attached to a back support element 208 as shown in FIG. 14. The back cushion 222 is thereby further stabilized.

Further, the stadium cushion 200 according to one aspect of the present invention is further attached to the stadium seat using the seat attachment element 240 as shown in FIG. 14. The seat attachment element 240 is stretched over the seat 206 by positioning the seat cushion 220 such that the seat 206 is slid between the seat attachment element 240 and the seat cushion 220. The seat attachment element 240 thereby stabilizes and maintains the position of the seat cushion 220 in relation to the seat 206.

Alternatively, the stadium cushion 200 could also be attached to any club seat as described herein. In a further alternative, the stadium cushion 200 is intended to be attachable to several other types of stadium seating.

Although the present invention has been described with reference to preferred embodiments, persons skilled in the art will recognize that changes may be made in form and detail without departing from the spirit and scope of the invention.

What is claimed is:

1. A cushion for use with a stadium seat of the type having a seat, a seat back, and a seat back support attaching the seat back to the seat, the cushion comprising:

(a) a seat cushion comprising a first side portion and a second side portion and a seat attachment element having a first end and a second end and engageable with the seat, the seat attachment element being attached at the first end to the first side portion of the seat cushion and the second end to the second side portion of the seat cushion;

(b) a back cushion comprising a first side portion and a second side portion and a seat back attachment element having a first end and a second end and engageable with the seat back, the seat back attachment element being attached at the first end to the first side portion of the back cushion and the second end to the second side portion of the back cushion;

(c) at least one flexible connection element attached to the seat cushion and the back cushion; and (d) at least one support attachment element engageable with the seat back support to couple the back cushion to the seat back support, the at least one support attachment element being attached to the back cushion and being attachable to the seat back support without the use of tools, and further wherein the at least one support attachment element once attached to the seat back support cannot be readily removed from the seat back support without the use of a tool.

2. The cushion of claim 1 wherein the at least one support attachment element is a zip-tie.

3. The cushion of claim 1 wherein the seat attachment element is a strap.

4. The cushion of claim 1 wherein the seat attachment element is stretchable.

5. The cushion of claim 1 wherein the seat back attachment element is a strap.

6. The cushion of claim 1 wherein the seat back attachment element is stretchable.

7. A cushion for use with a stadium seat of the type having a seat, a seat back, and a seat back support component attaching the seat back to the seat, the cushion comprising:

(a) a seat cushion engageable with the seat;

(b) a back cushion comprising a first side portion and a second side portion;

(i) a stretchable strap having a first end and a second end and engageable with the seat back, the stretchable strap being attached at the first end to the first side portion of the back cushion and the second end to the second side portion of the back cushion; and (ii) at least one support attachment element engageable with the seat back support component to couple the back cushion to the seat back support component, the at least one support attachment element being attached to the back cushion and being attachable to the seat back support without the use of tools, and further wherein the at least one support attachment element once attached to the seat back support cannot be readily removed from the seat back support without the use of a tool; and (c) at least one flexible strap attached to the seat cushion and the back cushion.

8. The cushion of claim 7 wherein the at least one support attachment element is a zip-tie.

9. The cushion of claim 7, further comprising a seat cushion stretchable strap -attached at each end to the seat cushion, the seat cushion stretchable strap being engageable with the seat to couple the seat cushion to the seat.

10. A method of attaching a cushion to a seat, the method comprising:

positioning a seat cushion comprising a first side portion and a second side portion on a seat so that the seat is positioned between the seat cushion and a seat attachment element having a first end and a second end and which is attached at the first end to the first side portion of the seat cushion and the second end to the second side portion of the seat cushion;

positioning a back cushion comprising a first side portion and a second side portion on a seat back so that the seat back is positioned between the back cushion and a seat back attachment element having a first end and a second end and which is attached at the first end to the first side portion of the back cushion and the second end to the second side portion of the back cushion; and attaching at least one support attachment element to a seat back support component wherein the at least one support attachment element is attached to the seat back support without the use of tools, and further wherein the at least one support attachment element once attached to the seat back support cannot be readily removed from the seat back support without the use of a tool.

11. The method of claim 10 wherein the at least one support attachment element is a zip-tie.

* * * * *